US006416276B1

(12) United States Patent
Marmilic et al.

(10) Patent No.: US 6,416,276 B1
(45) Date of Patent: Jul. 9, 2002

(54) HEAT SHIELD DEVICE IN GAS TURBINES

(75) Inventors: Robert Marmilic, Nussbaumen; Uy-Liem Nguyen, Dättwil; Ulrich Waltke, Neuenhof, all of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/537,100

(22) Filed: Mar. 29, 2000

(30) Foreign Application Priority Data

Mar. 29, 1999 (DE) ..... 199 14 227

(51) Int. Cl.[7] ..... F01D 5/08

(52) U.S. Cl. ..... 415/178; 415/115; 415/116; 416/95; 416/191; 416/193 A; 416/198 A; 416/201 R; 416/215

(58) Field of Search ..... 416/95, 96 R, 416/190, 191, 193 R, 193 A, 198 A, 201 R, 215, 216, 218, 204 R, 204 A, 244 R, 244 A; 415/115, 116, 176, 178, 216.1

(56) References Cited

U.S. PATENT DOCUMENTS

| | | | | | |
|---|---|---|---|---|---|
| 2,892,503 | A | * | 6/1959 | Hood, Jr. et al. | 416/244 R |
| 3,597,109 | A | * | 8/1971 | Petrie et al. | 416/198 A |
| 3,801,220 | A | * | 4/1974 | Beckershoff | 416/215 |
| 4,910,958 | A | * | 3/1990 | Kreitmeier | 416/95 |
| 5,743,713 | A | | 4/1998 | Hattori et al. | |
| 5,961,286 | A | * | 10/1999 | Schaub et al. | 416/215 |

FOREIGN PATENT DOCUMENTS

| | | | | |
|---|---|---|---|---|
| CH | 242918 A | * | 11/1946 | 416/201 R |
| CH | 296109 A | * | 1/1954 | 416/198 A |
| GB | 2 251 897 | | 7/1997 | |
| GB | 2 312 254 | | 10/1997 | |
| JP | 2-169804 | | 6/1990 | |

* cited by examiner

*Primary Examiner*—Christopher Verdier
(74) *Attorney, Agent, or Firm*—Burns, Doane, Swecker & Mathis, L.L.P.

(57) ABSTRACT

A rotor (1) of a turbomachine comprises a basic rotor element (2) and a multiplicity of rotor blades (3, 3', 3", 3'"). The rotor blades (3, 3', 3", 3'") are arranged in a distributed manner in at least one row on the circumference of the basic rotor element (2). An area for a row of guide vanes is furthermore provided in front of and/or behind the row of rotor blades. A heat shield element (4) or a plurality of heat shield elements (4', 4', 4'") lined up on the circumference of the rotor (1) is arranged in such a way between the basis rotor element (2) and the rotor blades (3, 3', 3", 3'") of the row of rotor blades that the basic rotor element (2) is completely covered in the areas of the row of rotor blades and the row of guide vanes. In this arrangement, the heat shield elements (4, 4', 4", 4'") each extend at least over the area of one row of rotor blades and at least part of the area of at least one row of guide vanes.

25 Claims, 7 Drawing Sheets

HEAT SHIELD DEVICE IN GAS TURBINES

BACKGROUND OF THE INVENTION

1. Field of the Invention

The present invention relates to heat shield devices which are used in turbomachines, especially in gas turbines.

2. Description of the Related Art

The high cycle efficiencies of turbo- or hydrodynamic machines, especially gas turbines, which are now customary can only be achieved using high compression ratios of the working fluid in a compressor of the turbomachine. Air is generally used as the. working fluid here. High compression ratios or pressure ratios in a compressor lead in turn to the temperature of the flowing fluid at the compressor outlet rising as well. However, the temperatures of the working fluid resulting from the now customary compression of the fluid to about 30 bar or above are often above the maximum permissible material temperatures of the components of the turbomachine. Particularly in the compressor, the materials used hitherto have generally been materials with only a limited heat resistance. On the one hand, these materials with limited heat resistance are significantly cheaper than materials of higher heat resistance and moreover frequently have further advantages, such as good machineability or higher tensile strength. It is therefore desirable to continue manufacturing the components from these materials of lower heat resistance, particularly in the compressor zone. While, in the area of a rotor, the basic rotor element is protected from the working fluid by blade end elements of platform-like design, the basic rotor element is exposed directly to the working fluid, especially in the area of a stator constructed without a shroud ring. In order to prevent overheating of the basic rotor element, in particular, during the operation of the turbomachine, heat-accumulation segments were arranged here in the areas in which the basic rotor element is not protected from the working fluid by the blade end elements of the rotor blades (e.g. in DE 196 15 549). This arrangement comprises plate-shaped elements which are matched to the contour of the basic rotor element and can be secured on the basic rotor element by means of special anchoring devices. While the basic rotor element is produced from a simple ferritic material, the heat shield element is manufactured from a material which is highly heat resistant. However, the arrangement described in DE 196 15 549,especially the securing of the heat-accumulation segments, involves a very high outlay in terms of design and consequently is very expensive to produce. Moreover, this arrangement leads to a larger number of components of the turbomachine, giving rise in turn to higher costs, especially for assembly and maintenance. Another disadvantage of this arrangement is the increased risk that the rotor blades will scrape against the heat-accumulation segments. One reason for this increased risk is the difference in material properties, in particular different coefficients of thermal expansion and thermal conductivity of the guide vanes, the basic rotor element and the heat-accumulation segments, leading to thermal expansions which progress at different rates during the starting of the turbomachine or in the case of load changes of the turbomachine. Moreover, the components are subject to dimensional tolerances inherent in their manufacture. Owing to the increased number of components, it is easy for a situation to arise in which the gap between the guide vanes and the heat-accumulation segments is less than a nominal gap. This reduced dimensional accuracy of the gap can in turn lead to rubbing of the components in the event of mechanical or thermal expansion. Such rubbing leads at the very least to abrasion of the guide-vane tip and of the heat-accumulation segment, leading to enlargement of the gaps and consequently to a reduction in the efficiency of the turbomachine. However, rubbing of the guide vanes can also lead to damage of the guide vanes and even to the guide vanes breaking off.

SUMMARY OF THE INVENTION

It is therefore the object of the invention to provide a device with the aid of which a basic rotor element of a rotor can be protected from the high temperatures of the working fluid and the disadvantages of the prior art can be avoided in an advantageous manner. At the same time, it should, in particular, be possible to produce the devices according to the invention with a low outlay on manufacture and thus economically in comparison with the prior art.

In addition to the basic rotor element, also referred to as the rotor disk, a conventional rotor, in particular a rotor of a turbomachine, comprises a multiplicity of rotor blades which are arranged in at least one row on the circumference of the basic rotor element. There is furthermore generally a row of guide vanes in front of or behind the row of rotor blades. The paired arrangement of in each case one row of rotor blades and one row of guide vanes is referred to as a stage of a compressor or a turbine of a turbomachine. Compressors or turbines of turbomachines generally comprise a plurality of stages arranged one behind the other. In a first aspect of the invention, a heat shield element or a plurality of heat shield elements lined up on the circumference of the basic rotor element is arranged between the basic rotor element of a rotor and the rotor blades of at least one row of rotor blades. According to the invention, the heat shield element or the lined-up heat shield elements in each case extends or extend in the axial longitudinal direction; of the basic rotor element at least both over the area of the row of rotor blades and over the area of a row of guide vanes positioned in front of or behind the row of rotor blades. In this arrangement, the heat shield element or heat shield elements completely surrounds and covers or surround and cover the basic rotor element in the areas of the row of rotor blades and the row of guide vanes. Over the entire circumference of the basic rotor element, the working fluid thus does not come into direct contact with the basic rotor element. As a consequence also, heat is not transmitted directly from the working fluid to the basic rotor element. The working fluid is here not necessarily the main working fluid of the turbomachine but can also be some other hot fluid from which the basic rotor element is to be shielded. An intermediate gap, which is as continuous as possible and in which a fluid, generally air, is advantageously present, preferably remains between the basic rotor element and the respective heat shield element. In order to transmit heat from the working fluid to the basic rotor element, multiple heat transfer is consequently required at the respective boundary surfaces and also conduction of the heat in the heat shield element. In this arrangement, the multiple heat transfer at the boundary surfaces advantageously increases the insulating effect of each heat shield element in relation to the basic rotor element. It has been found that, with the arrangement according to the invention of one or more heat shield elements, a significantly lower temperature is established in the basis rotor element than without these heat shield elements. It is thus possible, in the case of an arrangement according to the invention of the heat shield elements, to produce the basic rotor element from a material of limited heat resistance, e.g. a ferritic material, while the heat shield elements are preferably produced from highly heat resistant material, which preferably furthermore has a low thermal conductivity. The heat shield elements according to the invention are preferably employed in a compressor of a turbomachine since here even a slight reduction in the temperature loading of the basic rotor element is often sufficient to allow the use of ferritic materials for the basic rotor element.

By virtue of the embodiment according to the invention of the rotor, the outlay on manufacture can be considerably reduced compared with the embodiments known from the prior art. The embodiment according to the invention can thus be produced at considerably lower cost than previous embodiments. Moreover, dimensional accuracy of the arrangement is easier to achieve by virtue of the smaller number of components. This increases both the operational reliability and the efficiency of the turbomachine. The increase in efficiency results from the fact that the gaps between the heat shield elements and the guide vanes can be made smaller.

In a preferred embodiment of the invention, the heat shield element or heat shield elements extends or extend over a plurality of rotor-blade rows arranged one behind the other and over the areas between the rows of rotor blades. The rows of guide vanes are generally arranged in the areas between the rows of rotor blades in the overall assembly of the turbomachine. It is thus advantageously possible to further reduce the number of components. The number of joints between the heat shield elements is furthermore reduced. Joints of this kind are unwanted because it is possible here for working fluid to flow into the joints and thus for direct contact to occur between the working fluid and the basic rotor element.

A second aspect of the invention relates to a rotor, in particular a rotor of a compressor of a turbomachine, which comprises a basic rotor element and a multiplicity of rotor blades, the rotor blades being arranged in a distributed manner in at least two rows on the circumference of the basic rotor element. An area for a row of guide vanes is provided between the rows of rotor blades. According to the invention, one or more heat shield elements lined up on the circumference of the rotor are arranged in such a way between the basic rotor element and the rotor blades of each row of rotor blades that, when assembled, the heat shield elements completely surround and cover the basic rotor element in the areas of the rows of rotor blades and the row of guide vanes. In this arrangement, the heat shield elements also extend into the area of the row of guide vanes. In this arrangement, it is advantageous if the heat shield elements each extend into the center of the area of the row of guide vanes. The mode of operation of the heat shield elements in accordance with the second aspect of the invention is fundamentally the same as the mode of operation of the heat shield elements, arranged in the rotor, in accordance with the first aspect of the invention. However, an embodiment in accordance with the second aspect of the invention offers the advantage that only rotor blades of one row of rotor blades or even each rotor blade itself is/are arranged on one heat shield element. The rotor blades of each row of rotor blades can thus be adjusted and, in particular also, balanced independently of the rotor blades of the next row of rotor blades. Moreover, if the heat shield elements are aligned at incorrect angles there are only slight deviations in the gap dimensions between the heat shield element and the guide vanes thanks to the small length dimensions of the heat shield elements. The gap between the heat shield elements and the guide vanes, which is to be designed in such a way that no rubbing of the guide vanes against the heat shield elements occurs, can consequently be made smaller. The heat shield elements in accordance with the second aspect of the invention are preferably also produced from a highly heat-resistant material, expediently with a low thermal conductivity.

The preferred embodiments of the invention presented below are based both on the first and on the second aspect of the invention.

In a preferred embodiment of the invention, the heat shield element is designed as a closed circular ring. In this arrangement, the rotor blades are preferably arranged on the circular ring. The self-contained circular ring completely surrounds the basic rotor element. A heat shield element embodied as a closed circular ring furthermore offers the advantage of a very small number of components. The circular ring can be preassembled with the rotor blades arranged on the circular ring before being arranged on the basic rotor element in a final assembly operation. The embodiment of the heat shield element as a circular ring furthermore results in the advantage of uniform distribution of mass on the circumference of the rotor. The uniformly distributed centrifugal forces caused by rotation lead to a self-centering concentric arrangement of the circular ring. On the basic rotor element. Moreover, temperature changes cause uniform radial expansion of the circular ring. It is a relatively simple matter here to match the thermal expansion of the components surrounding the rotor in the turbomachine, e.g. a casing, with the thermal expansion of the rotor.

As an alternative, the heat shield elements are expediently embodied as segments of a circular ring. The segments of the circular ring preferably extend over an angular range of 10 to 30 degrees. The segments lined up on the circumference of the basic rotor element form a self-contained circular ring surrounding the basic rotor element. The joints remaining between the individual segments are here made so small that only a small amount of working fluid flows into the joint. This only slight inflow of working fluid into a joint also leads to an only slightly increased thermal loading of the basic rotor element in the area of the basic rotor element adjoining the joint. Thanks to the segmentation of the circular ring, the heat shield elements can be mounted more easily on the basic rotor element. Moreover, reduced thermally induced stresses form in the heat shield elements in comparison with an embodiment of the heat shield element as a self-contained circular ring.

It is advantageous if the heat shield element or the heat shield elements has or have for the purpose of securing the rotor blades, at least one slot which extends essentially in the circumferential direction of the rotor and in which the rotor blades engage in a form-fitting manner by means of an engagement element in each case. The rotor blades are thus secured releasably on the heat shield element or heat shield elements. If, for example, individual rotor blades are damaged during operation, it is possible to renew just the damaged rotor blades in each case. It is also expediently possible for a plurality of slots extending essentially in the circumferential direction to be provided parallel to one another in the heat shield element or heat shield elements, by means of which a plurality of rows of rotor blades can be secured next to one another. However, it is equally possible, though implemented less often in practice for reasons connected with blade strength, to provide the slots in the rotor blades and the engagement elements on the heat shield elements. As an alternative to this, it is also possible, in another advantageous configuration, to embody the heat shield element or heat shield elements in one piece with the respective rotor blades arranged thereon. In this arrangement, the rotor blades are preferably produced as a casting together with the respective heat shield element. However, they can also be produced by machining. The one-piece embodiment on the one hand reduces the number of components and, on the other hand, significantly reduces the outlay on assembly. Moreover, there is no longer any need for complex design measures for securing the blades, as a result of which production costs are reduced. The heat shield element or heat shield elements is/are preferably in each case secured on the basic rotor element by means of one or more slots extending essentially in the axial direction and by means of engagement elements engaging in a form-fitting manner in these slots. Here, it is possible either for the slots to be made in the basic rotor element and the engagement elements on the heat shield elements or, conversely, to have the engagement elements on the basic rotor element and the slots in the heat shield elements. The heat shield elements can thus be pushed onto the basic rotor element and can also be dismantled again in the event of damage.

If a plurality of heat shield elements is lined up on the circumference of the basic rotor element or in the axial longitudinal direction of the basic rotor element, there is generally a joint remaining in each case between the heat shield elements, in particular for compensating for thermal expansion of the heat shield elements. It is expedient if the joint is sealed with a seal, preventing the working fluid from entering the joint. For this purpose, a seal, e.g. stuffing-type packing, a cord packing or a laminar strip seal, is preferably placed in slots in the form of slits which are arranged in the side walls of the joint. Such sealing of joints between heat shield elements is advantageous especially if, in a preferred embodiment of the invention, a flow of cooling fluid is passed through the intermediate gap or a plurality of intermediate gaps between the basic rotor element and the heat shield element or heat shield elements. For this purpose, the intermediate gap has a cooling-fluid inlet and a cooling-fluid outflow passage or an outlet opening which opens into the flow of the working fluid, for example. It is particularly expedient to make the intermediate gap between the heat shield element and the basic rotor element as continuous as possible. Here, the flow of cooling fluid serves, in particular, to cool the heat shield element or heat shield elements on their respective rear sides, which face the basic rotor element. Heat which penetrates a heat shield element is thus passed into the flow of cooling fluid and consequently does not pass into the basic rotor element.

BRIEF DESCRIPTION OF THE DRAWINGS

The invention is explained in more detail below using exemplary embodiments in conjunction with the drawings, in which.

The drawings show only those elements which are essential to an understanding of the invention. In the drawings, parts which act in the same way are provided with the same reference numerals.

DETAILED DESCRIPTION OF THE PREFERRED EMBODIMENTS

Figure 1:
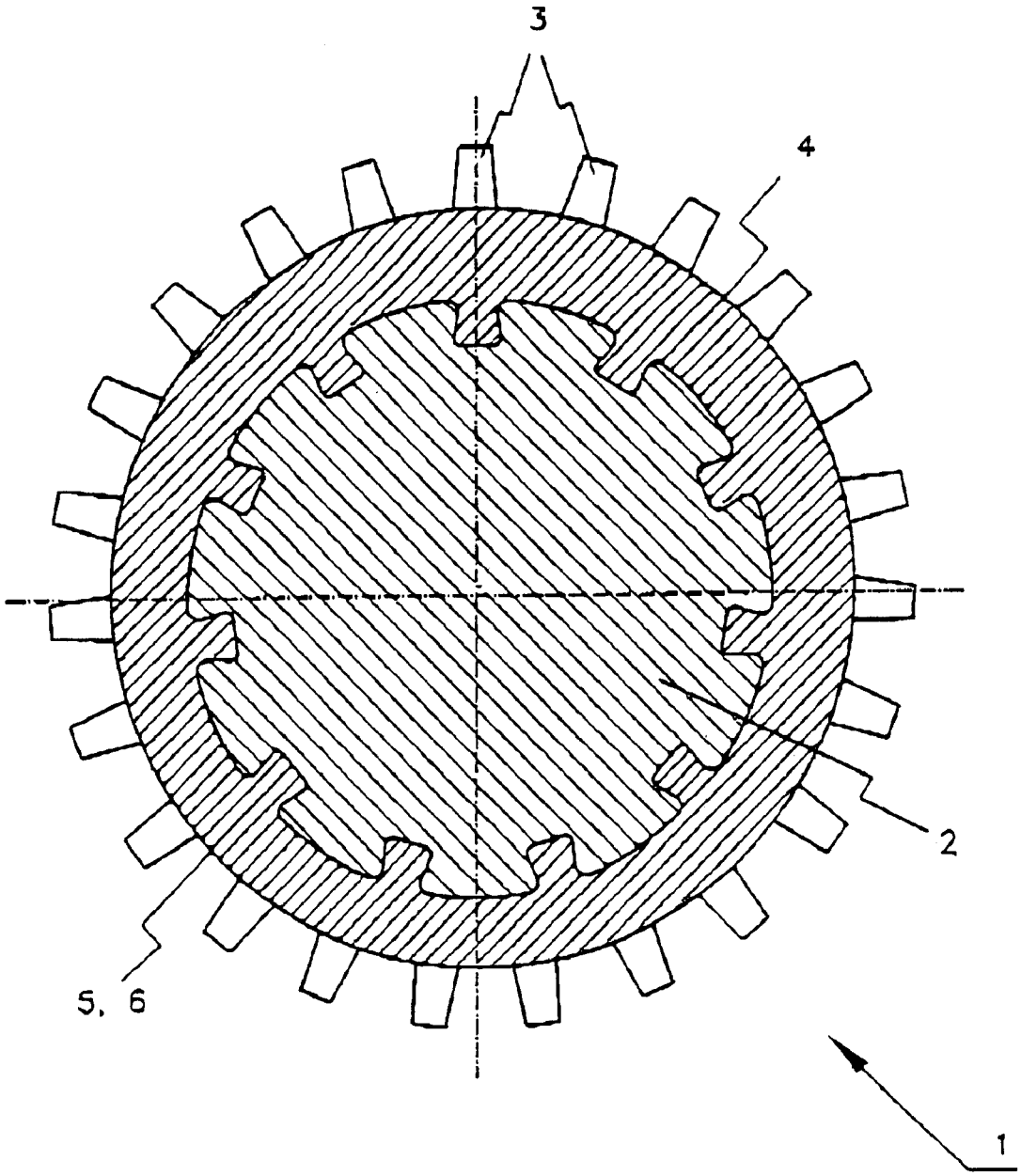
FIG. 1 shows a schematic cross section through a rotor according to the invention with a heat shield element embodied as a closed circular ring.

FIG. 1 shows, in a schematic representation, a cross section through a rotor 1 according to the invention. The rotor 1 comprises a basic rotor element 2 and a multiplicity of rotor blades 3 which are arranged in a distributed manner on the circumference of the basic rotor element 2. According to the invention, a heat shield element 4 is furthermore arranged between the basic rotor element 2 and the rotor blades 3. Here, the heat shield element 4 is designed as a closed circular ring, the circular ring preferably being produced from a material resistant to high temperatures and the material furthermore expediently having a low thermal conductivity. The rotor blades 3 are arranged on the heat shield element 4. Since the section plane illustrated is located ahead of the row of rotor blades, the manner in which the rotor blades 3 are secured on the heat shield element 4 cannot be seen. The rotor blades are preferably secured on the heat shield element by means of slots and engagement elements which engage in these slots. However, the heat shield element can also be embodied in one piece with the rotor blades, e.g. as a casting. The heat shield element 4 illustrated in FIG. 1 is secured on the basic rotor element 2 by means of slots 5 and by means of engagement elements 6. For this purpose, the engagement elements 6 are designed in such a way that they engage in a form-fitting manner in the slots 5. Here, the slots 5 are provided in the basic rotor element 2, whereas the engagement elements 6 are connected to the heat shield element 4 and the engagement elements 6 are preferably embodied in one piece. Conversely, however, it is likewise possible to arrange the slots 5 in the heat shield element 4. As illustrated in FIG. 1, the heat shield element 4 and the engagement elements 6 on the basic rotor element 2. The slots 5 extend essentially axially in the direction of the axis of the turbomachine. This allows the heat shield element 4 to be mounted easily on the basis rotor element 2 by sliding it on axially. At the same time, the forces which arise during rotation and act in the circumferential direction are transmitted very well without significant transverse forces being induced in the axial direction by force transmission. In the embodiment of the invention illustrated in FIG. 1, the circular ring 4 surrounds the basic rotor element 2 completely. Here, the flow duct of the turbomachine is thus delimited by the circular ring 4 on the hub side. The term flow duct is used to denote the open cross section of flow via which the fluid flows through the turbomachine. The blades of a turbomachine are thus arranged in the flow duct. Due to the provision of a heat shield element in accordance with FIG. 1 the working fluid flowing through the flow duct does not come into direct contact with the basic rotor element 2. Accordingly, it is also, impossible for heat to be transmitted directly to the basic rotor element 2 by the fluid. Heat transmission from the fluid to the basic rotor element 2 here takes place only if the heat is first of all transmitted from the fluid to the heat shield element 4 and from there to the basic rotor element 2 by means of heat conduction and at least one further heat transfer. By virtue of the low thermal conductivity of the heat shield element 4 and/or the multiple heat transfer between the fluid and the heat shield element 4 and between the heat shield element 4 and the basic rotor element 2 combined with simultaneous heat dissipation in the basic rotor element 2, the temperature in the basic rotor element 2 is significantly lower than the temperature of the working fluid and than the temperature which would be established in the basic rotor element 2 in the case of an arrangement without a heat shield element 4. Heat dissipation in the basic rotor element 2 is often based on the removal of heat from the interior of the basic rotor element 2 by means of cooling circuits in the interior of the rotor 1 or other cooling devices. Thanks to the reduced temperature loading, the basic rotor element 2 can thus be produced from a material of limited heat resistance, thereby considerably reducing production costs for the rotor.

Figure 2:
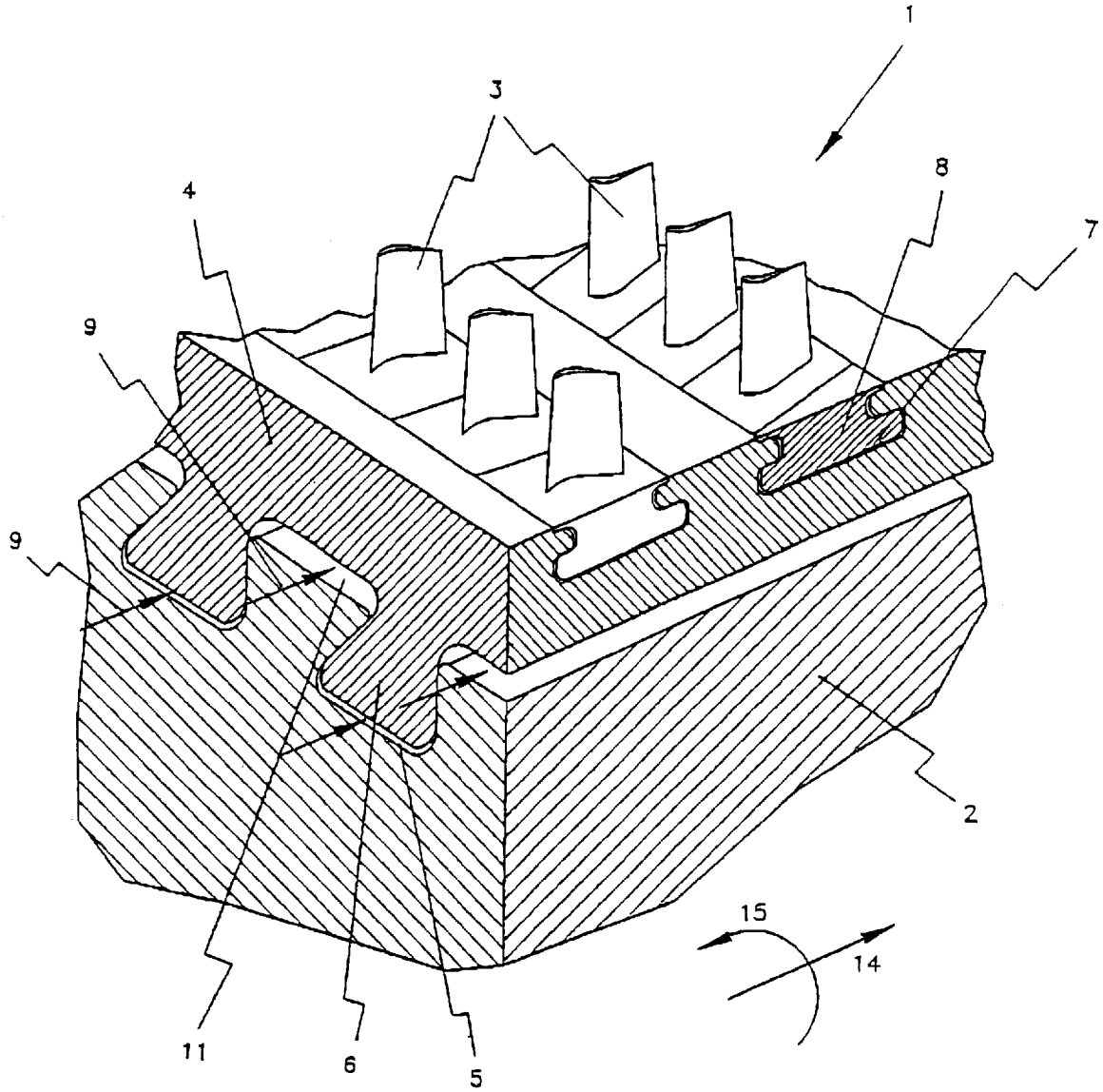
FIG. 2 shows a perspective view of a section through a rotor with a heat shield element embodied as a closed circular ring.

A perspective view of a section through a rotor 1 with a heat shield element 4 embodied in accordance with the invention is illustrated in FIG. 2. Here, the heat shield element 4 is embodied in the same way as in FIG. 1, as a closed circular ring, and is arranged between the rotor blades 3 and the basic rotor element 2. According to the illustration, the rotor blades 3 are arranged in at least two rows on the circumference of the basic rotor element 2. The rotor blades 3 are secured on the heat shield element 4 by means of slots 7 and engagement elements 8. Here, the slots 7 are embodied as T slots in the heat shield element 4 and extend in the circumferential direction. The engagement elements 8 engage in a form-fitting manner in the slots 7. The form fit between the engagement elements 8 and the slots 7 is preferably embodied here with a slight clearance in order to allow alignment of the rotor blades 3 in accordance with the centrifugal forces which arise during rotation. Internal transverse stresses, which would occur in the case of misalignment of the rotor blades 3, are thus avoided. The rotor blades 3 are each embodied in one piece with the engagement elements 8. In the assembled arrangement of the turbomachine, guide vanes are arranged in the areas between two rows of rotor blades in each case, these guide vanes generally being secured on the casing of the turbomachine. The heat shield element 4 embodied as a circular ring is secured on the basic rotor element 2 in the same way as already described in relation to FIG. 1 by means of slots 5 and by means of engagement elements 6 which engage in these slots 5. The slots 5 and therefore also the engagement elements 6 are here of dovetail design. There furthermore preferably remains between the heat shield element 4 and the basic rotor element 2 an as far as possible continuous intermediate gap 11 through which, as illustrated in FIG. 2, a cooling fluid 9 flows. This cooling fluid 9 serves to absorb heat which is transmitted from the working fluid to the heat shield element 4 and penetrates the heat shield element 4 and preferably to dissipate it by means of forced convection. It is thus possible to further significantly reduce the amount of heat transmitted to the basic rotor element 2. Given appropriate choice of materials and an appropriate choice of the geometrical dimensions required by the design, heat dissipation by the cooling fluid flowing through the intermediate gap 11 may even be sufficient to render further cooling of the rotor in its interior superfluous. The intermediate gap 11 in FIG. 2 is in each case interrupted by the engagement elements 6 formed on the heat shield element 4. In order to reduce heat transfer between the heat shield element 4 and the basic rotor element 2 even in the interrupted areas, the slots 5 are here made somewhat deeper, thus allowing cooling fluid 9 to flow through the slots even along the underside of the engagement elements 6. Heat is thus now transmitted from the heat shield element 4 to the basic rotor element 2 only at the side flanks of the engagement elements 6.

Figure 3:
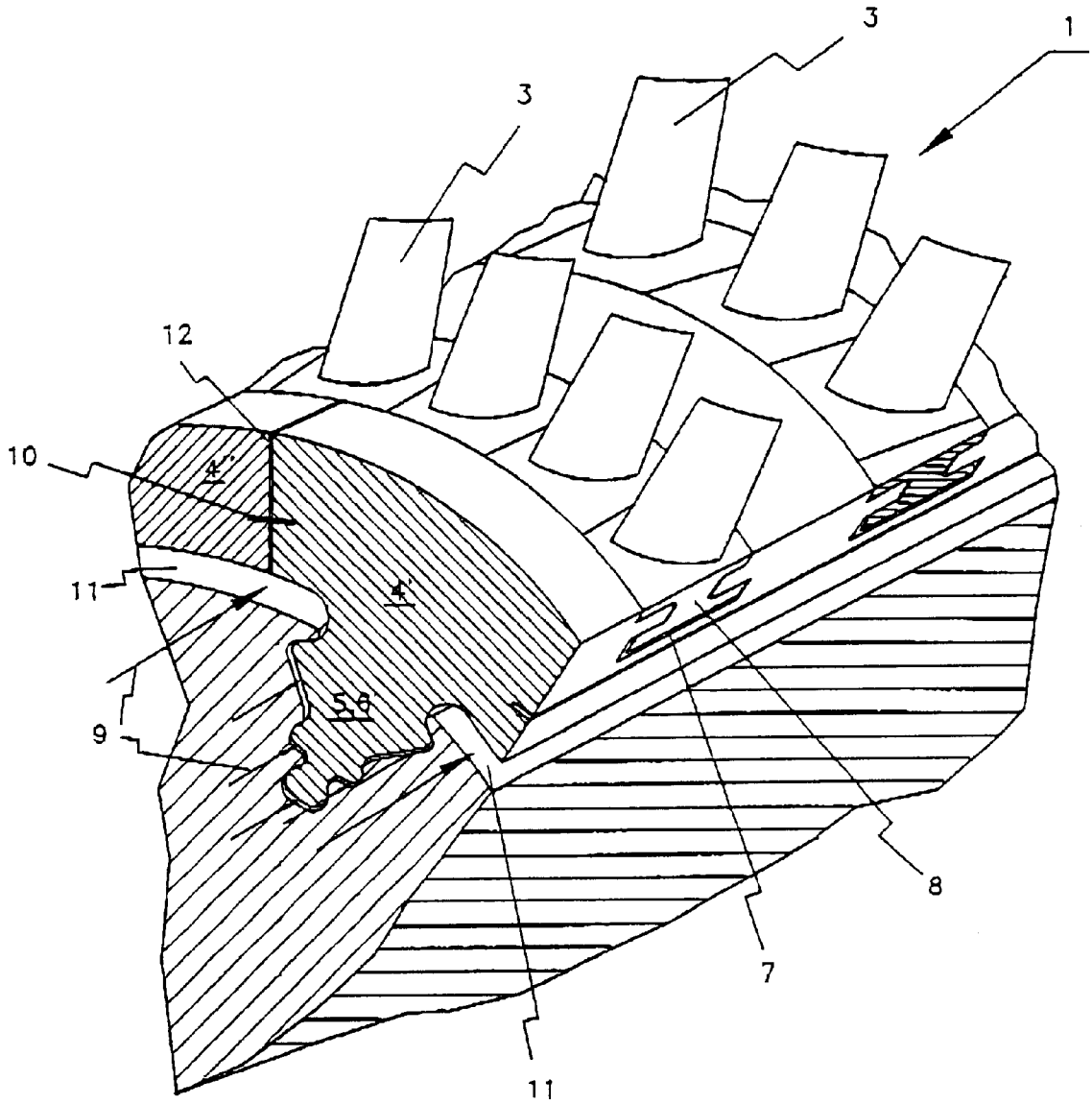
FIG. 3 shows a perspective view of a rotor with heat shield elements arranged in accordance with the invention, the heat shield elements being embodied as segments of a circular ring.

FIG. 3 shows an embodiment of the invention similar to that illustrated in FIG. 2. Here, however, the circular ring arranged as a heat shield element 4 on the circumference of the basic rotor element 2 in FIG. 2 is divided into segments. Each individual segment 4', 4" acting as a heat shield element here covers the basic rotor element 2 over an angular range of about 20 degrees of angle. To shield the basic rotor element 2 completely from the working fluid, a multiplicity of segments 4', 4" is thus lined up on the circumference of the basic rotor element 2. Running between the segments 4', 4" are joints 12, these being provided, in particular, to compensate for thermally induced expansion of the segments 4', 4". These joints 12 are sealed by means of seals 10. Suitable seals 10 here are, in particular, laminar insertion seals or stuffing type packings, which are placed in slits provided in the segments 4', 4". On the one hand, this prevents the working fluid from flowing into the joint 12 and, on the other hand, prevents escape of the cooling fluid 9 flowing through the intermediate gap 11 between the basic rotor element 2 and the heat shield elements 4', 4". The engagement elements 6 used to secure the segments 4', 4" on the basic rotor element 2 are here designed as fir-tree roots. The associated slots 5 have corresponding contours. The mode of action of the heat shield elements 4', 4" illustrated in FIG. 3 corresponds to the mode of action of the embodiment of the invention in accordance with FIG. 2. However, one advantage of dividing the circular ring into segments is that the individual segments 4', 4" are easy to install. More particularly also, it is easy to replace individual segments in the event of a repair. Moreover, if the segments are subjected to elevated temperatures, lower internal thermally induced stresses occur in the segments 4', 4" in comparison with the circular ring since thermal expansion of the segments is not hindered.

Figure 4:
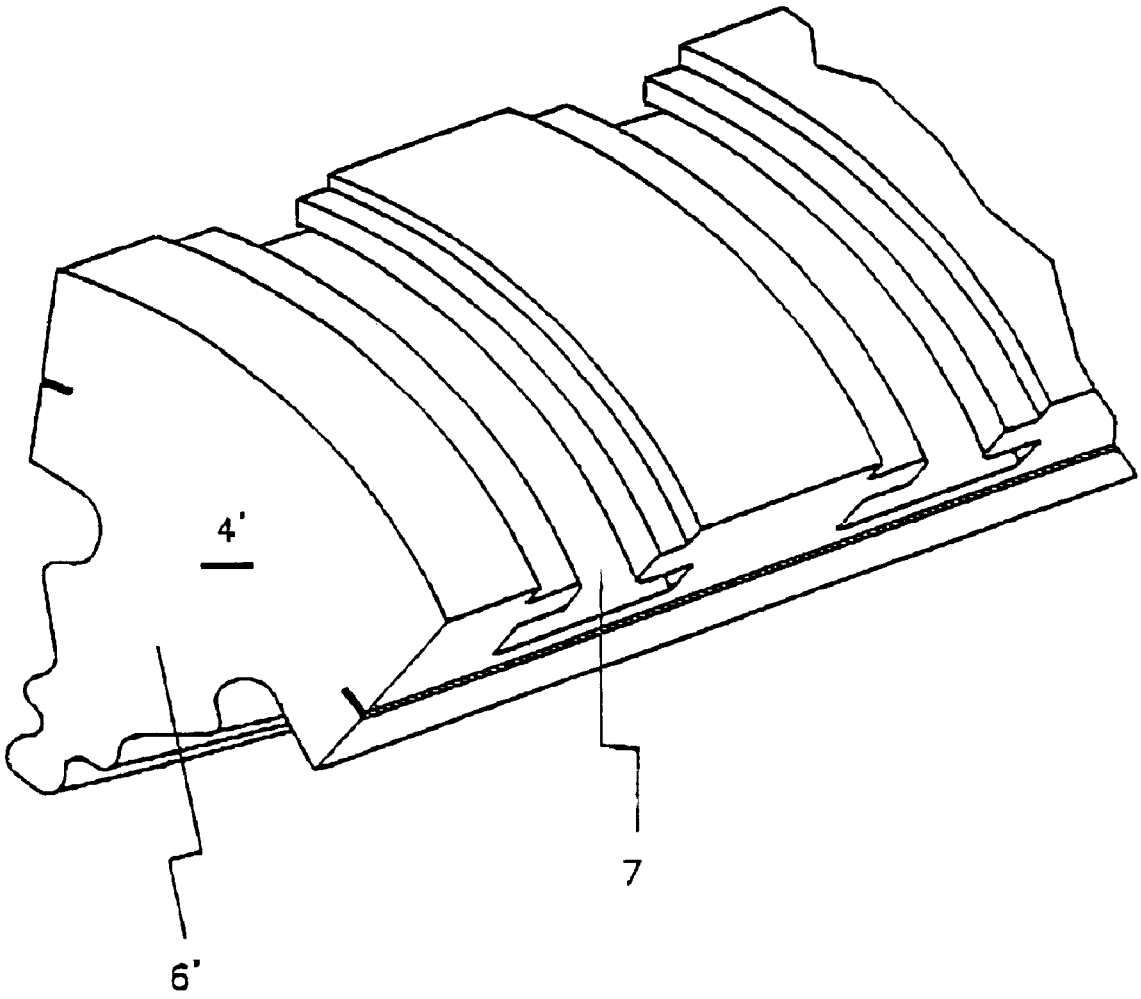
FIG. 4 shows a heat shield element from FIG. 3 in isolation.

FIG. 4 shows a heat shield element 4' as an isolated component which is embodied as a segment of a circular ring. Thanks to the significantly smaller dimensions of a segment in comparison with the complete circular ring, such a component is significantly simpler to produce, e.g. by milling or casting.

Figure 5:
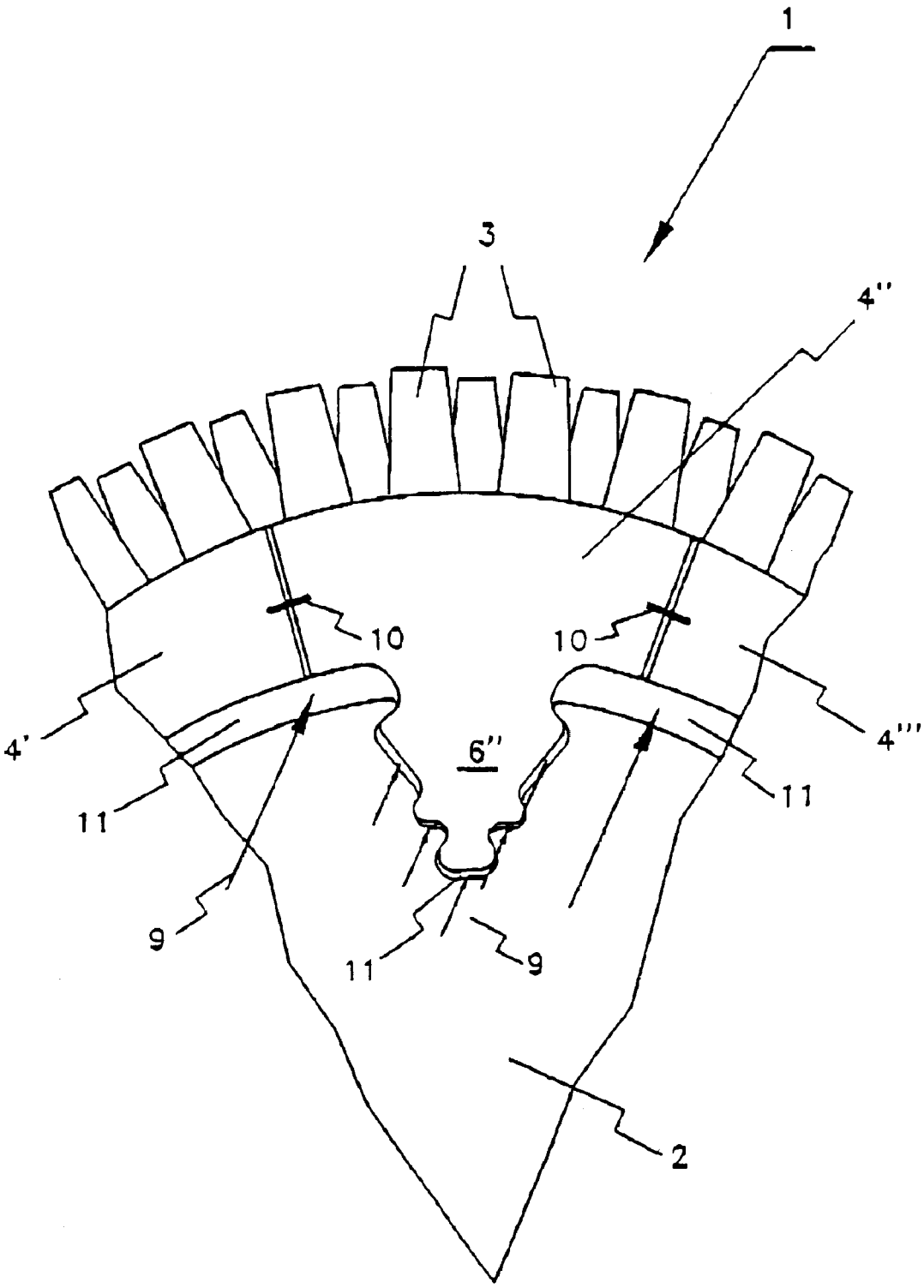
FIG. 5 shows part of a cross section through a rotor with heat shield elements arranged in accordance with the invention, the heat shield elements being embodied in one piece, as segments of a circular ring, with the rotor blades arranged on the heat shield elements.

FIG. 5 shows part of a cross section through another rotor 1 according to the invention. Once again, heat shield elements 4', 4", 4'" embodied as segments of a circular ring are arranged between the basic rotor element 2 and the rotor blades 3 arranged on the circumference of the basic rotor element 2. Once again, the heat shield elements 4', 4", 4'" are lined up and enclose the basic rotor element 2, thus preventing direct contact between the basic rotor element 2 and the working fluid. Moreover, the heat shield elements 4', 4", 4'" are here in each case embodied in one piece with the respective rotor blades 3 arranged theron. Heat shield elements 4', 4", 4'" of this kind embodied in one piece with the rotor blades 3 can be produced by casting or milling for example. One advantage of this embodiment of the invention is the extremely small number of individual components of the rotor 1, thereby considerably reducing the outlay on assembly. The joints 12 between the individual heat shield elements 4', 4", 4'" are sealed by means of seals 10 against ingress of the working fluid into the joints 12 and/or escape of the cooling fluid 9 from the intermediate gap 11. As already explained in the description relating to FIG. 3, the cooling fluid 9 flows in the intermediate gap 11 or in a plurality of intermediate gaps between the basic rotor element 2 and the heat shield elements 4', 4", 4'". This intermediate gap 11 is formed so as to be as continuous as possible at the circumference of the basic rotor element 2 and has at least one inflow passage for supply of the cooling fluid 9 and an outflow facility for the cooling fluid. The outflow facility can here be designed as an outflow passage or, alternatively, merely as an opening which opens into the main flow.

Figure 6:
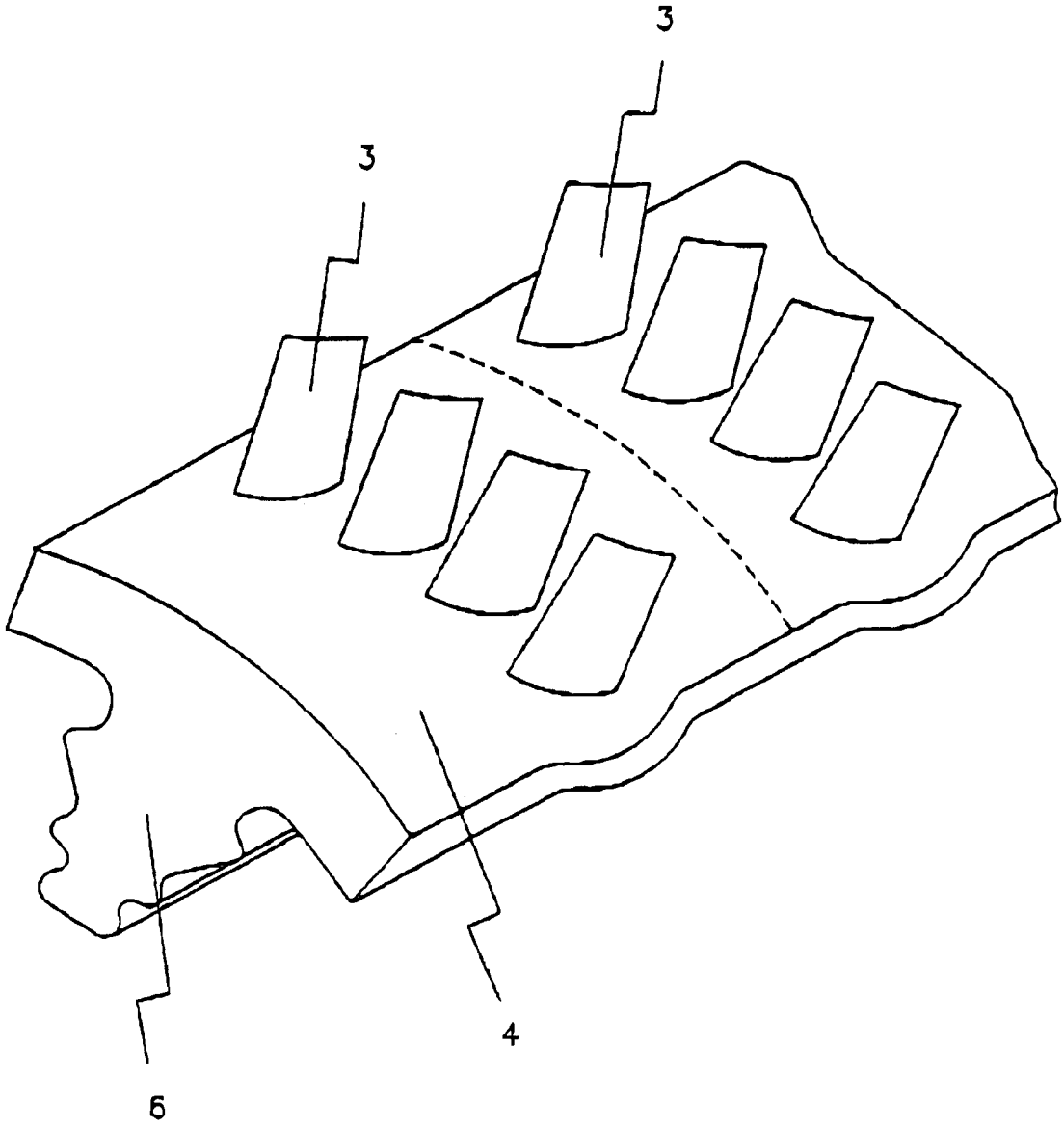
FIG. 6 shows a heat shield element from FIG. 5 in isolation.

FIG. 6 shows a heat shield element 4 in accordance with the embodiment of the invention illustrated in FIG. 5 but as an isolated part. The one-piece embodiment of such a heat shield element 4 with the rotor blades arranged on it is advantageous and extremely economical particularly when the rotor blades do not have excessive three-dimensional twist.

Figure 7:
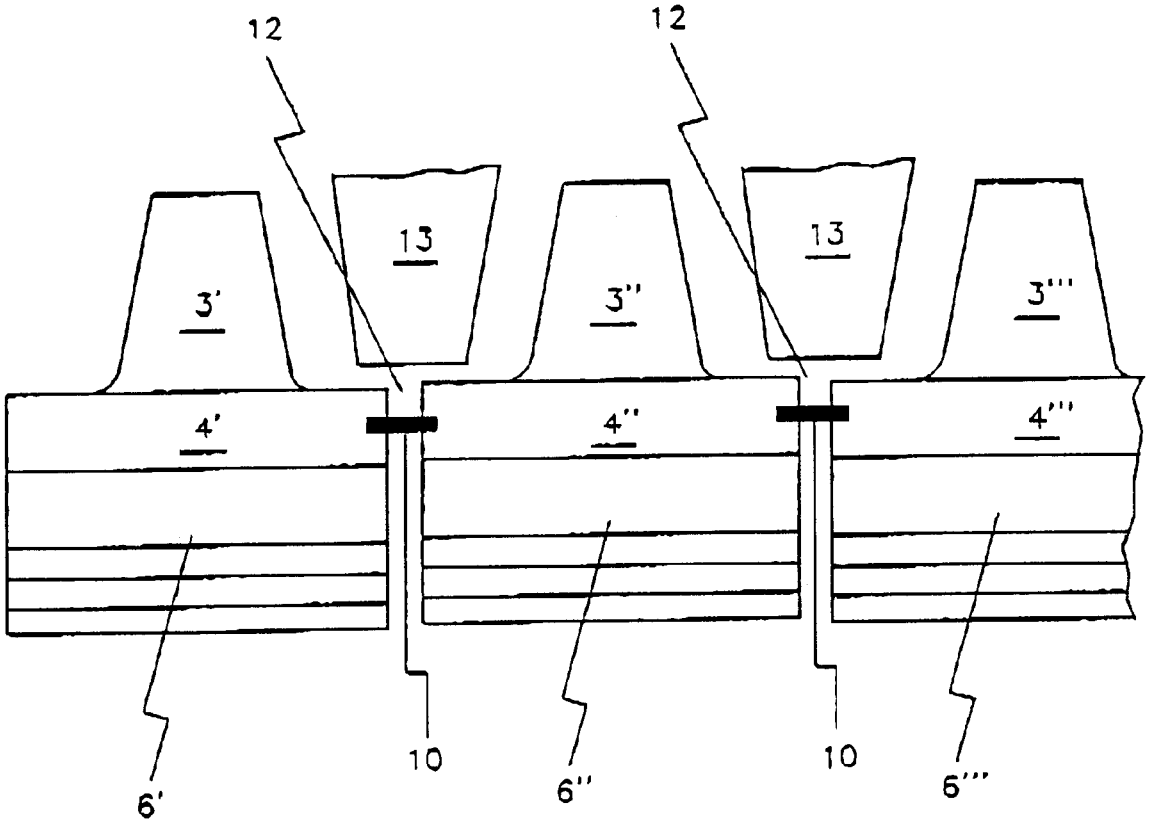
FIG. 7 shows a longitudinal section through an arrangement of a plurality of heat shield elements lined up one behind the other.

FIG. 7 shows a longitudinal section through an arrangement of a plurality of heat shield elements 4', 4", 4'" lined up one behind the other. The heat shield elements 4', 4", 4'" are each embodied in one piece with the rotor blades 3', 3", 3'" arranged on them. Also illustrated here are the guide vanes 13 of two rows of guide vanes which project into the areas between two rows of rotor blades in each case. In the axial direction each of the heat shield elements 4', 4", 4'" illustrated extends approximately, as far as the center of the areas between a row of guide vanes in front of the row of rotor blades and a row of guide vanes behind the row of rotor blades. The heat shield elements 4', 4", 4'" designed as segments are lined up both in the axial direction and around the circumference of the basic rotor element 2, with the result that they completely surround and cover the basic rotor element 2. The basic rotor element 2 is thus shielded from the working fluid. The joints 12 between the heat shield elements 4', 4", 4'" are once again sealed by means of seals 10. In comparison with the embodiments of the invention which have already been described, this embodiment of the invention offers the advantage that the rows of rotor blades can be manufactured and installed separately from one another. Moreover, it is particularly advantageous, especially in the case of complex three-dimensional contouring of the rotor blades, to segment the circular ring in such a way, even in the circumferential direction, that only one or a few rotor blades are arranged on each segment. A manufacturing fault in one rotor blade then does not mean that a large number of rotor blades becomes unusable scrap. Even in the case of a repair, individual rotor blades or small groups of rotor blades can be renewed in a targeted manner without having to remove a larger number of still intact rotor blades as well. Moreover, a rotor can be more easily balanced if rotor blades can be repositioned in small blade groups or if, in the extreme case, each rotor blade can be repositioned on the circumference of the rotor. The fact that the heat shield elements 4', 4", 4'" lined up in the axial direction extend as far as the areas of the preceding and/or following row of guide vanes allows the number of individual components of the rotor to be reduced considerably in comparison with solutions known from the prior art. At the same time, the small dimensions of the heat shield elements 4', 4", 4'" offer high security against the guide vanes 13 scraping against the heat shield elements 4', 4", 4'" even if the heat shield elements 4', 4" 4'" are aligned at an incorrect angle.

What is claimed is:

1. A rotor having a basic rotor element and a multiplicity of rotor blades, the rotor blades being arranged in at least one row on the circumference of the basic rotor element, and a zone for a row of guide vanes being provided axially offset and neighboring the at least one row of rotor blades, wherein a heat shield element or a plurality of heat shield elements lined up on the circumference of the rotor is arranged between the basic rotor element and the rotor blades of the at least one row of rotor blades, said heat shield element or elements axially extending over the zone for the row of guide vanes and completely covering the basic rotor element in the zones of the at least one row of rotor blades and the row of guide vanes, wherein the heat shield element or heat shield elements each being secured on the basic rotor element by means of one or more slots extending essentially in the axial direction and by means of engagement elements engaging in a form-fitting manner in this slot or slots, the heat shield element or the heat shield elements having, for the purpose of securing the rotor blades, at least one slot which extends essentially in the circumferential direction and in which the rotor blades engage in a form-fitting manner by means of at least one engagement element.

2. The rotor as claimed in claim 1, the heat shield element or heat shield elements extending over a plurality of rows of rotor blades arranged one behind the other and over the areas provided for rows of guide vanes between the rows of rotor blades.

3. A rotor having a basic rotor element and a multiplicity of rotor blades, the rotor blades being arranged in at least two rows on the circumference of the basic rotor element, and a zone for a row of guide vanes being provided between the row of rotor blades, wherein a heat shield element or a plurality of heat shield elements is arranged between the basic rotor element and the rotor blades of the row of rotor blades, the heat shield element or heat shield elements also extending into the zone for the row of guide vanes, and the heat shield element or the heat shield elements lined up in the axial direction completely covering the basic rotor element in the zones of the row of rotor blades and the row of guide vanes, wherein the heat shield element or heat shield elements being secured on the basic rotor element by means of one or more slots extending essentially in the axial direction and by means of engagement elements engaging in a form-fitting manner in this slot or slots, the heat shield element or the heat shield elements having, for the purpose of securing the rotor blades, at least one slot which extends essentially in the circumferential direction and in which the rotor blades engage in a form-fitting manner by means of at least one engagement element.

4. The rotor as claimed in claim 1, the heat shield element or heat shield elements being embodied as a closed circular ring.

5. The rotor as claimed in claim 1, the heat shield element or heat shield elements being embodied as segments of a circular ring.

6. The rotor as claimed in claim 5, the heat shield elements embodied as segments extending over an angular range of 10 to 30 degrees on the circumference of the basic rotor element.

7. The rotor as claimed in claim 5, a joint between two heat shield elements arranged in succession in the axial direction or on the circumference being sealed by means of a seal.

8. The rotor as claimed in claim 1, at least one intermediate gap remaining between the basic rotor element and the heat shield element or heat shield elements.

9. The rotor as claimed in claim 8, a cooling fluid flowing in the intermediate gap between the basic rotor element and the heat shield element or the heat shield elements.

10. The rotor as claimed in claim 1, the heat shield element or the heat shield elements being composed of a material resistant to high temperatures.

11. The rotor as claimed in claim 1, the rotor being arranged in a compressor of the turbomachine.

12. The rotor as claimed in claim 1, wherein the rotor is used in connection with a turbomachine.

13. The rotor as claimed in claim 3, wherein the rotor is used in connection with a turbomachine.

14. The rotor as claimed in claim 7, wherein said seal being placed in slits.

15. The rotor as claimed in claim 10, wherein the heat shield element or the heat shield elements being composed of a material with a low thermal conductivity.

16. The rotor as claimed in claim 3, the at least one heat shield element or heat shield elements being embodied as a closed circular ring.

17. The rotor as claimed in claim 3, the heat shield element or heat shield elements being embodied as segments of a circular ring.

18. The rotor as claimed in claim 3, at least one intermediate gap remaining between the basic rotor element and the heat shield element or heat shield elements.

19. The rotor as claimed in claim 3, the heat shield element or heat shield elements being composed of a material resistant to high temperatures.

20. The rotor as claimed in claim 3, the rotor being arranged in a compressor of a turbomachine.

21. The rotor as claimed in claim 6, wherein a joint between two heat shield elements arranged in succession in the axial direction or on the circumference being sealed by means of a seal.

22. The rotor as claimed in claim 1, wherein the heat shield element or heat shield elements being embodied as a casting.

23. The rotor as claimed in claim 3, wherein the heat shield element or heat shield elements being embodied as a casting.

24. The rotor as claimed in claim 17, the heat shield segments embodied as segments extending over an angular range of 10 or 30 degrees on the circumference of the basic rotor element.

25. The rotor as claimed in claim 17, a joint between two heat shield elements arranged in the axial direction or on the circumference being sealed by means of a seal.

* * * * *